US011965385B2

(12) United States Patent
Sonnier et al.

(10) Patent No.: US 11,965,385 B2
(45) Date of Patent: Apr. 23, 2024

(54) MODIFIED CASING RUNNING TOOL AND METHOD OF USING THE SAME

(71) Applicant: McCoy Global Inc., Edmonton (CA)

(72) Inventors: Gareth Dustin Sonnier, Austin, TX (US); Matthew J. Hickl, Midfield, TX (US); Richard Chism, Round Rock, TX (US)

(73) Assignee: MCCOY GLOBAL INC., Edmonton (CA)

( * ) Notice: Subject to any disclaimer, the term of this patent is extended or adjusted under 35 U.S.C. 154(b) by 0 days.

(21) Appl. No.: 17/018,011

(22) Filed: Sep. 11, 2020

(65) Prior Publication Data

US 2021/0071515 A1 Mar. 11, 2021

Related U.S. Application Data

(60) Provisional application No. 62/898,675, filed on Sep. 11, 2019.

(51) Int. Cl.

| | |
|---|---|
| ***E21B 19/06*** | (2006.01) |
| ***E21B 7/20*** | (2006.01) |
| ***E21B 19/10*** | (2006.01) |
| ***E21B 19/16*** | (2006.01) |
| ***E21B 44/04*** | (2006.01) |
| ***E21B 47/01*** | (2012.01) |
| ***E21B 47/13*** | (2012.01) |

(52) U.S. Cl.

CPC ..... *E21B 19/06* (2013.01); *E21B 7/208* (2013.01); *E21B 19/166* (2013.01); *E21B 44/04* (2013.01); *E21B 47/01* (2013.01); *E21B 47/13* (2020.05); *E21B 19/10* (2013.01)

(58) Field of Classification Search

CPC ..... E21B 19/06; E21B 19/10; E21B 19/166; E21B 44/04; E21B 23/00; E21B 47/01; E21B 47/13; E21B 7/208

See application file for complete search history.

(56) References Cited

U.S. PATENT DOCUMENTS

| | | | | |
|---|---|---|---|---|
| 2015/0021016 | A1 | 1/2015 | Deng et al. | |
| 2015/0041150 | A1* | 2/2015 | Sulima | E21B 19/16 166/380 |
| 2017/0067303 | A1* | 3/2017 | Thiemann | F01C 21/18 |
| 2017/0247234 | A1 | 8/2017 | Guidry | |
| 2019/0106977 | A1* | 4/2019 | Amezaga | E21B 19/14 |
| 2019/0128114 | A1* | 5/2019 | Bryant | E21B 45/00 |

* cited by examiner

*Primary Examiner* — Caroline N Butcher
(74) *Attorney, Agent, or Firm* — FIELD LLP

(57) ABSTRACT

A casing running tool is provided, including one or more sensors built into the casing running tool; an electronics housing that includes one or more power sources for powering the one or more sensors; one or more circuit boards for converting sensor data for transmission and transmission means for transmitting sensor data. The one or more sensors sense tool status and operational parameters of the casing running tool. A system is also provided for detection, processing and transmission of one or parameters of tool status and operational status of a casing running tool or associated tools in a casing installation or casing while drilling operation. The system includes a casing running tool; and a processor for receiving sensor data for processing and transmitting processed data in real-time for viewing by an operator. A method is further provided for performing a casing installation or casing while drilling operation.

22 Claims, 8 Drawing Sheets

FIGURE 4
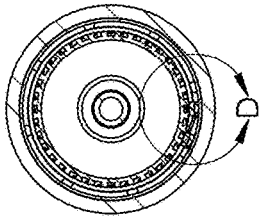
SECTION C-C
SCALE 1 : 16
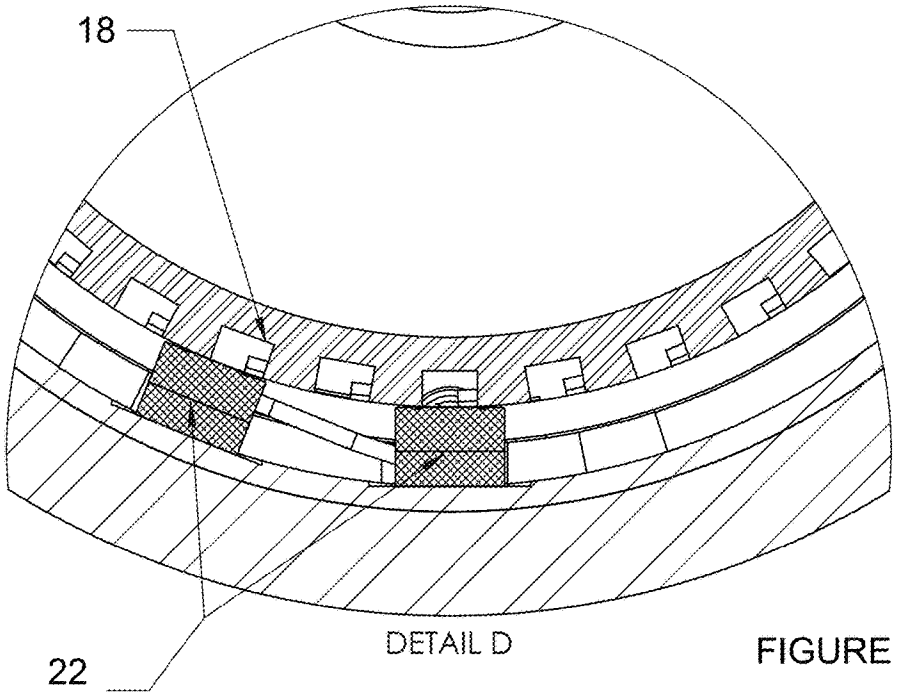
DETAIL D
FIGURE 4A

Sensors Shown without CRT componet

Sensors Integrated inside CRT Component

MODIFIED CASING RUNNING TOOL AND METHOD OF USING THE SAME

FIELD

A modified casing running tool (CRT) and system are provided for collecting, processing and transmitting information on tool status and operational status to an operator.

BACKGROUND

A typical procedure for making up casing strings, also called tubular strings, involves positioning a new joint of casing or tubular to be made up, below a casing running tool (CRT) and above a casing string to be made up, the casing string being gripped in place by a flush mount spider or similar device. The casing joint is then lowered so that the male thread of the casing joint is engaged with the female thread of the uppermost casing of the casing string and the CRT rotatably grips the casing joint, either internally or externally.

A top drive is rotated to make up the threads between the new casing joint and the uppermost casing of the casing string. The CRT's gripping mechanism grips the new casing joint and transfers the weight of the newly made up connection from the spider, so that the spider can be released. The CRT assembly then lowers the newly made up connection to the rig floor where the spider grips an upper end of the newly made up casing section of the casing string. The CRT gripping mechanism is then released from the casing joint.

Casing running tools conduct a number of complex operations and are typically made up of numerous moving and working parts that function when loads are applied to them. The casing running tool must be able to carry large loads while rotationally gripping the casing joint to be made up.

During the casing installation, there is a requirement to monitor and record the thread make-ups to ensure that the connection joints match the connection profile provided from the tubular manufacturers. The forces being applied to the tubular joint are also measured and recorded.

Casing Running Tools (CRT) can be built in many configurations and can be either mechanically or hydraulically activated. Hydraulic CRT's tend to be integrated with the top drive. Mechanical CRT's are independent tools that are connectable to the top drive.

The CRT is joined to the top drive on the rig which is controlled by a driller or operator. The driller controls the top drive to perform a series of movements that apply a sequence of loads to the CRT. These sequences of loads being applied causes the CRT to set or unset. A common problem is that the loads applied are subjected to external impacts such as friction, temperature and environmental conditions which cause the loads intended to be approximate and very commonly misapplied.

Since the mechanical CRT is independent (standalone) without specific connectivity to the operator or top drive controls, there are only visual indications on the CRT that communicate the current state of set or unset of the tool. These visual indications are a primitive means and are often inaccurate in communicating the true state of the CRT. There are most commonly both horizontal and vertical stripes that indicate degree of internal rotation and extension/retraction state, as seen in FIGS. 1A to 1B. During the setting activity, the CRT is typically located high above the operator's position, making these visual indications very difficult to interpret.

In the past torque subs have been used to sense and communicate certain aspects of the CRT operation such as load, torque, turns, pressure, etc. However torque subs are a separate unit to the CRT device itself, connected, for example just between the top drive and the CRT. As such the torque sub cannot detect parameters relating to the mechanical operation of the parts of the CRT. The torque sub also only collects data, it does not perform calculations, for example a torque sub will not compute combined load or combined load limits.

Another complex requirement of a CRT is a limit of combined loads that must not be exceeded. All CRT tools are limited to several load rating capacities. Generally, but not limited, these loads include hook load, torque and internal pressure. The load ratings are typically provided to the end user as a maximum rating when independently loaded, but when multiple loads are combined, each of the other load ratings must be reduced. This is referred to as combined loading. The combined loading limits are generally provided to the end user in the form of graphs that need to be referenced while the CRT is in use.

It is very common to have multiple forces acting on the CRT in daily operations. These combined loading charts must be referenced continually to not exceed these reduced ratings when combined forces are acting on the device. The combined loadings may be a limit of the tool or may be a loading limit for the tubular it is being used on.

It is necessary to measure the precise length of tubulars being inserted into the wellbore. This is typically performed by measuring each joint of tubular and then subtracting the make-up loss that occurs when a pin end of one tubular is threaded into a box end of another tubular and the threads overlap in length. These individual joints are rarely equal in length from one to the next, requiring a precise measurement and accounting of each joint.

A need therefore exists for the collection of accurate, real-time data from the CRT regarding its condition and operation, so that this data can be processed into useful information about the CRT status, operational status and operational limits and this information conveyed to operators.

SUMMARY

A casing running tool is provided. The casing running tool comprises one or more sensors built into the casing running tool; an electronics housing, said electronics housing comprising one or more power sources for powering said one or more sensors; one or more circuit boards for converting sensor data for transmission; and transmission means for transmitting sensor data. The one or more sensors sense tool status and operational parameters of the casing running tool comprising axial load, axial position, torque, turns, internal mud pressure, hook load, tension, rotation speed, rotational position, vibration, alignment, X, Y, Z acceleration and temperature.

A system is also provided for detection, processing and transmission of one or more parameters of tool status and operational status of a casing running tool or associated tools in a casing installation or casing while drilling operation. The system comprises the casing running tool described above; and a processor for receiving sensor data for processing and transmitting processed data in real-time for viewing by an operator.

A method is further provided for performing a casing installation or casing while drilling operation. The method comprises the steps of providing the casing running tool described above; transmitting sensor data on tool status and operational parameters during the operation to a processor; processing sensor data by the processor to determine information on casing running tool and operational status; transmitting information on casing running tool and operational status to an operator from the processor; and controlling and adjusting operational parameters of the casing running tool or associated tools.

It is to be understood that other aspects of the present disclosure will become readily apparent to those skilled in the art from the following detailed description, wherein various embodiments of the disclosure are shown and described by way of illustration. As will be realized, the disclosure is capable of other and different embodiments and its several details are capable of modification in various other respects, all without departing from the spirit and scope of the present disclosure. Accordingly the drawings and detailed description are to be regarded as illustrative in nature and not as restrictive.

BRIEF DESCRIPTION OF THE DRAWINGS

A further, detailed, description of the disclosure, briefly described above, will follow by reference to the following drawings of specific embodiments of the disclosure. The drawings depict only typical embodiments of the disclosure and are therefore not to be considered limiting of its scope. In the drawings:

FIG. 4 is a cross section end view of the CRT of FIG. 2, taken at line C-C;

FIG. 4A is a detailed cross section view from FIG. 4;

The drawings are not necessarily to scale and in some instances, proportions may have been exaggerated in order to more clearly depict certain features.

DETAILED DESCRIPTION OF VARIOUS EMBODIMENTS

The description that follows and the embodiments described therein are provided by way of illustration of an example, or examples, of particular embodiments of the principles of various aspects of the present disclosure. These examples are provided for the purposes of explanation, and not of limitation, of those principles and of the disclosure in its various aspects.

Generally speaking, the present disclosure provides a CRT having sensors integrally built within or on the CRT, wherein the sensored CRT is capable of corresponding with a processor for receiving sensor data from the sensored CRT and processing that data to calculate operational and tool parameters and conveying this information to an operator. In communicating with the processor, warnings regarding operation of the sensored CRT may be provided to the operator, and communication between the sensored CRT and the processor may also optionally control operation of the sensored CRT and of associated equipment like top drives and spiders gripping tubular strings on the rig floor. The present disclosure also provides a smart CRT system comprising a sensored CRT and a processor for receiving, processing and communicating sensor data.

This sensored CRT detects and provides feedback on loading conditions while integrating a source of torque turn data and streaming data from the CRT related to operations that are typically externally acquired. The sensored CRT can be part of a system for performing calculations on loading conditions, combined loads, and operational information while providing additional information such as joint tally length in hole.

Figure 1:
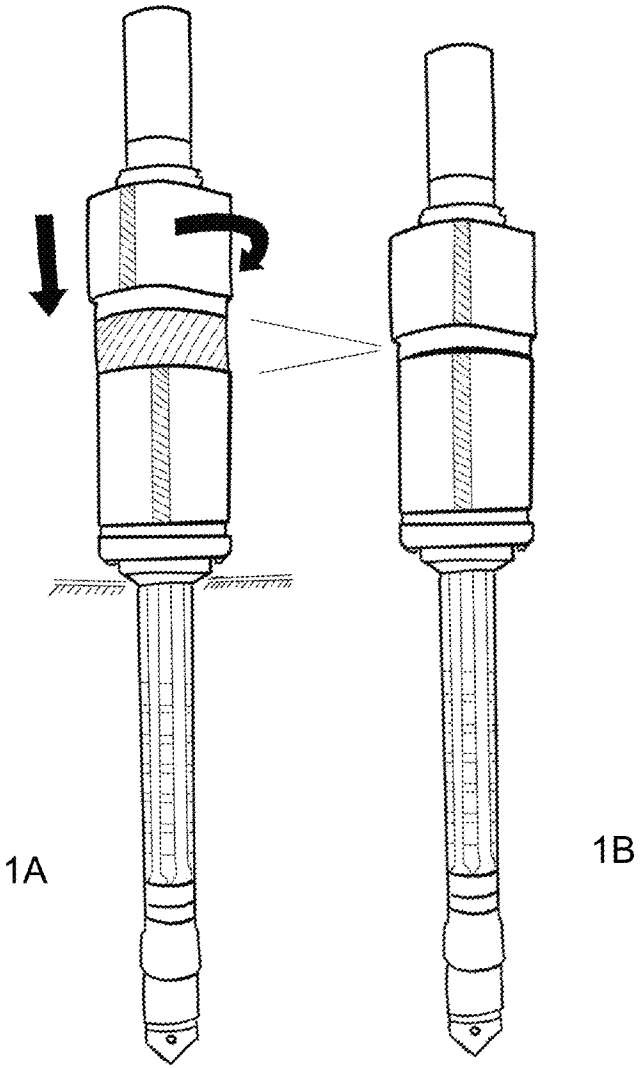
PRIOR ART FIGURE 1
FIGS. 1A to 1B depict an example of a prior art CRT with visual markers for makeup, and the tool in an axially compressed position.
Figure 2:
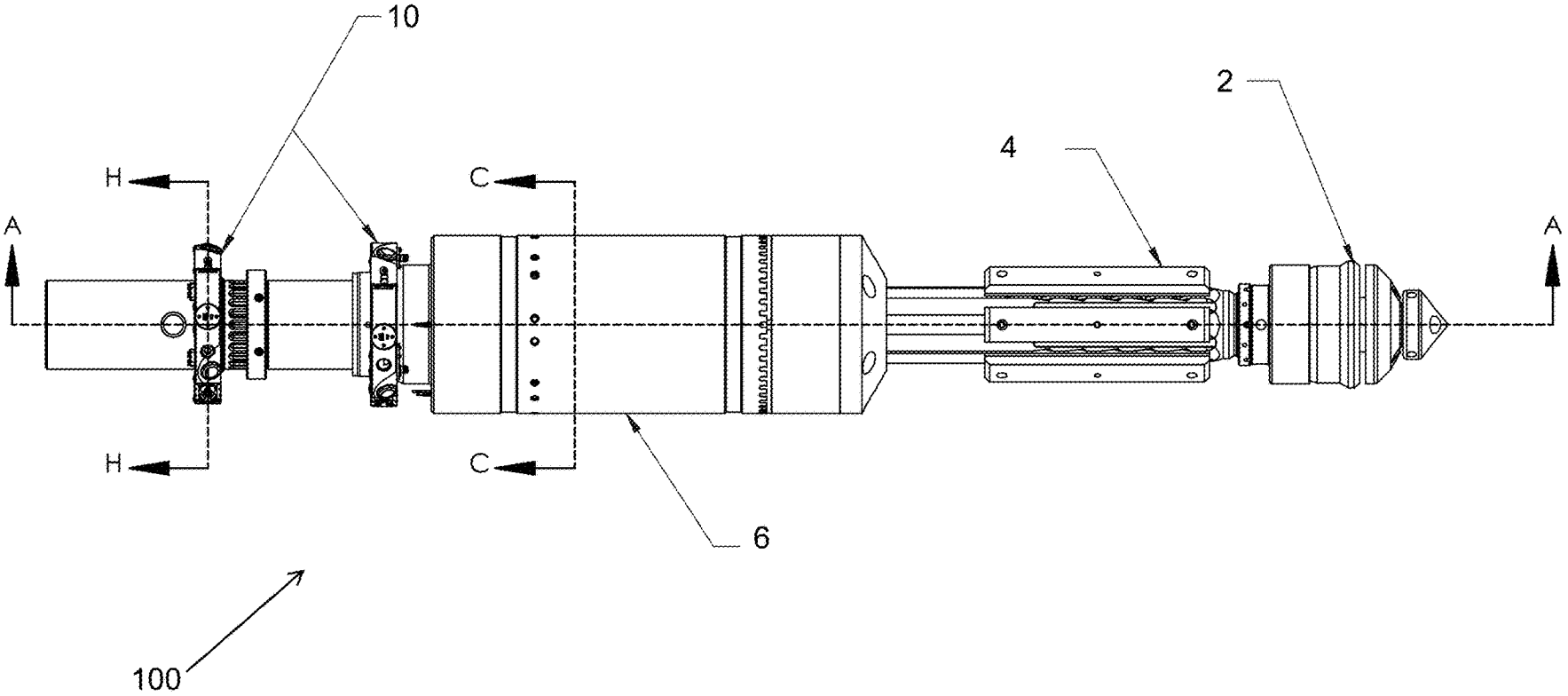
FIG. 2 is a side elevation view of one embodiment of a CRT of the present disclosure.

An example of a modified or sensored CRT 100 of the present disclosure is shown in FIG. 2. The CRT 100 includes a sealing end 2 and an internal gripping section 4 for gripping a joint of tubular. While the example CRT of FIG. 2 shows a gripping section for gripping an interior of a tubular joint, it is also possible for the present sensored CRT to have external gripping means to grip an exterior of a tubular joint. A gearbox houses mechanical elements 6 is used to set and unset the gripping section 4 of the CRT 100. An electronics housing 10 holds some sensors of the CRT 100, and also includes circuit boards and power source for the sensors and transmission means of transmitting the sensor signals.

Figure 3:
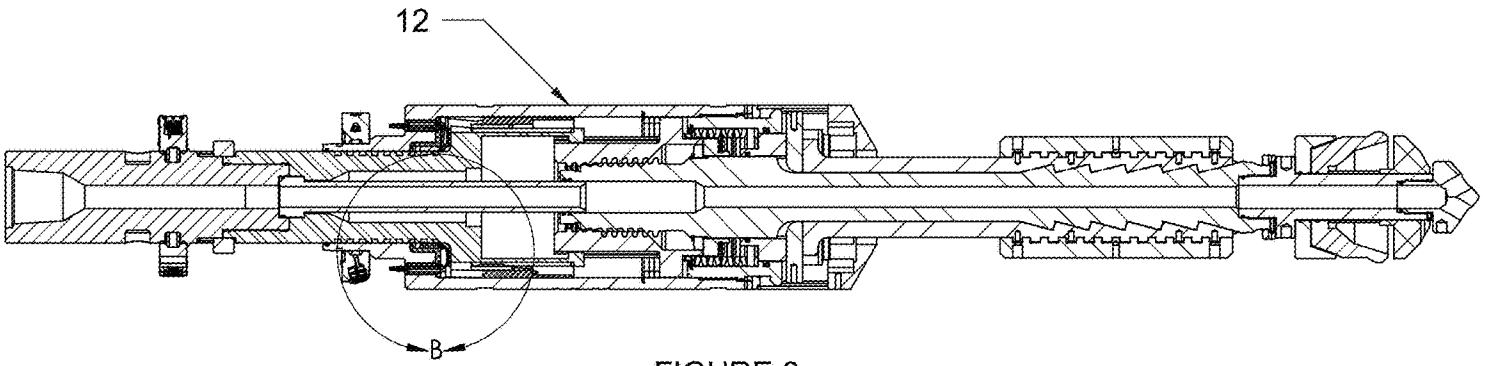
FIG. 3 is a cross sectional side view of the CRT of FIG. 2, taken at line A-A.
Figure 3A:
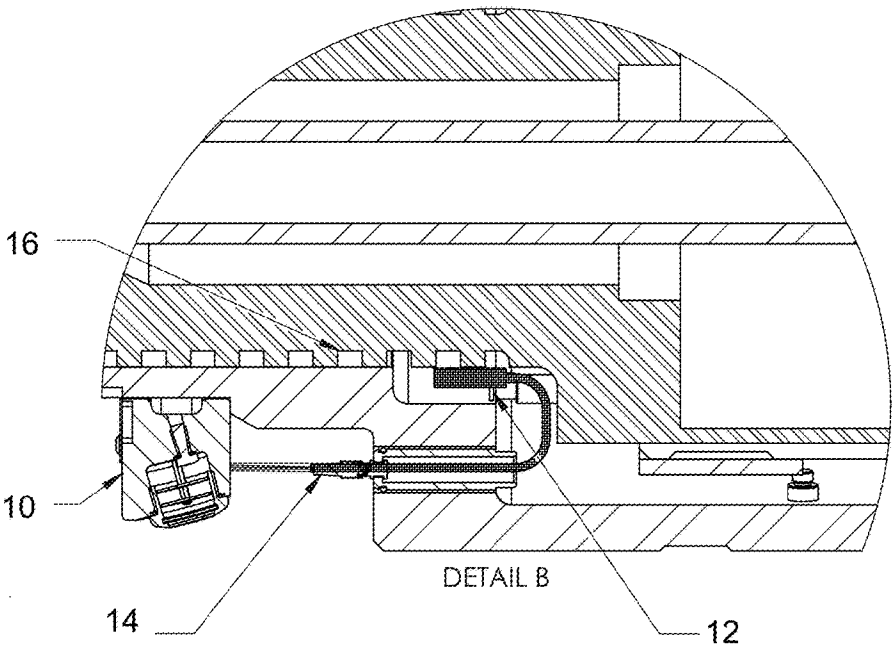
FIG. 3A is a detailed cross section view from FIG. 3.

Sensors are present directly on and in the mechanical elements, for example sensors 12 for detecting axial movement of the CRT and its gripping assembly, as seen in FIG. 3A, or sensors 22 for detecting rotational movement, as seen in FIG. 4A. In such cases, a conductor 14 connects and provides communication between the sensor 12/22 and the circuit boards in the electronics housing 10.

Relative movement of gear teeth 16 in FIG. 3A or gear teeth 18 in FIG. 4*a*, are measured by sensors 12/22 for determine axial and rotational movement.

Figure 6:
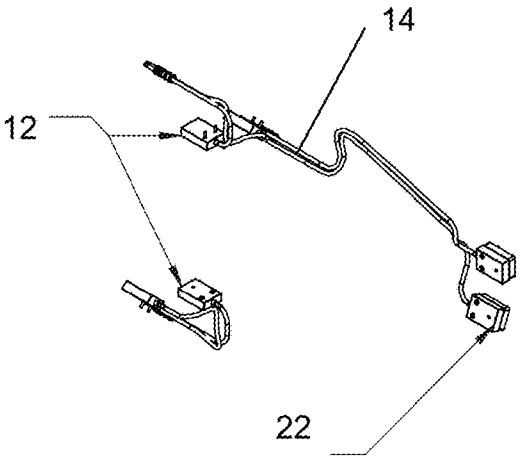
FIG. 6 is a perspective view of certain sensor types for use with the present sensored CRT.
Figure 5A:
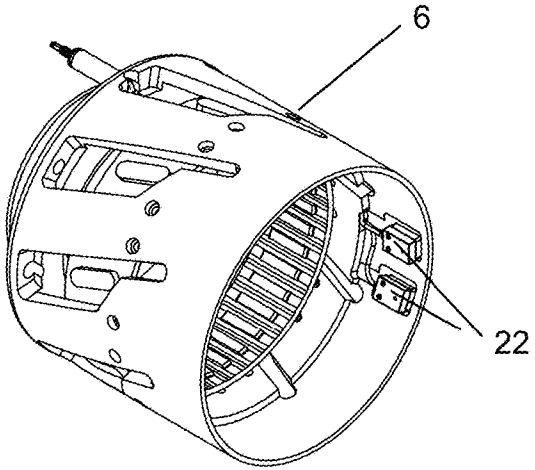
FIG. 5A is a detailed perspective view of a mechanical section of the CRT of FIG. 2, showing sensors integrated therein.
Figure 5B:
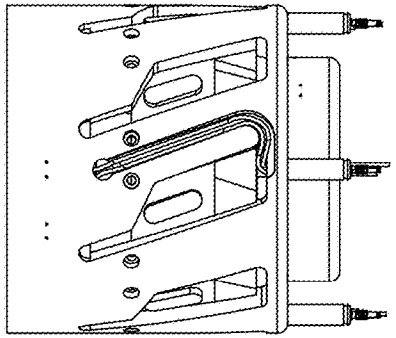
FIG. 5B is a side elevation view of the FIG. 5A.

Examples of the sensors of the present sensored CRT 100 are illustrated in more detail in FIGS. 5*a*, 5*b* and 6. With reference to FIG. 5A, a pair of rotational sensors 22 are illustrated in the mechanical elements 6. The sensors 22 can be any form of position sensor including but not limited to mechanical sensors, inductive sensors and optical sensors.

Figure 7:
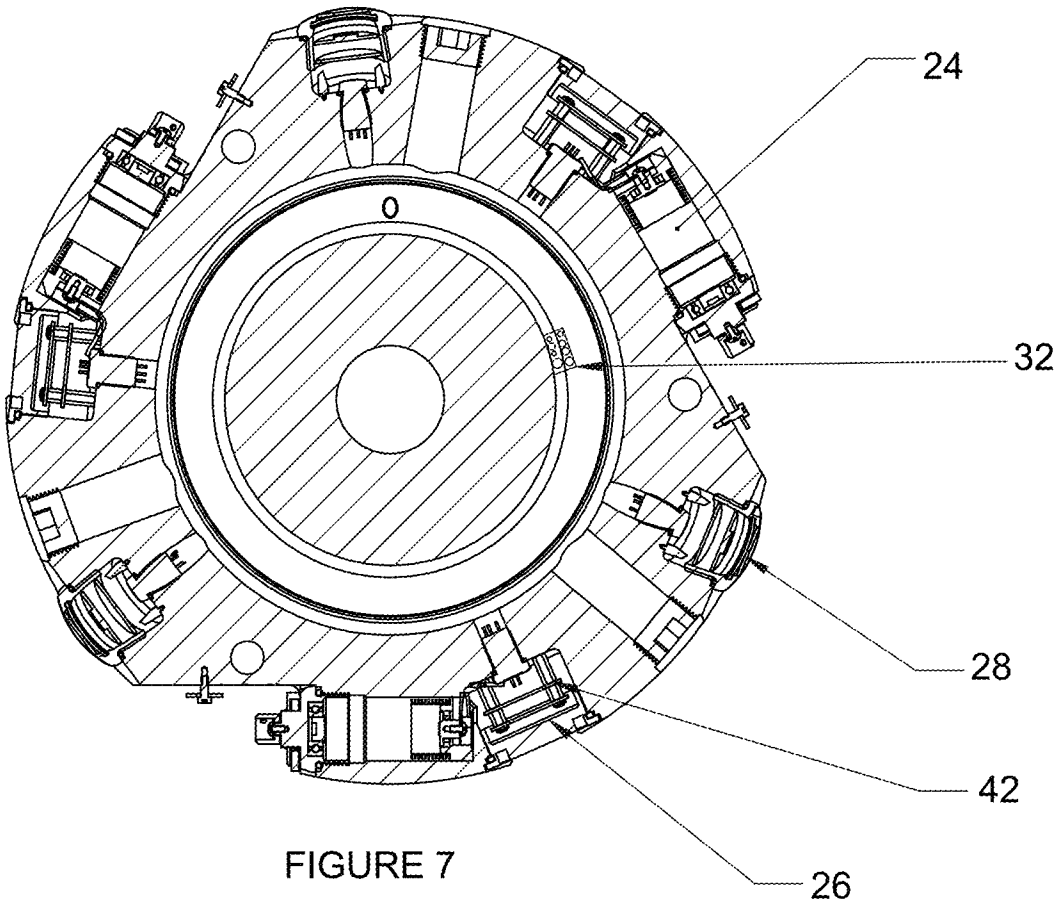
FIG. 7 is a cross sectional end view of the CRT of FIG. 2, take at line H-H showing the electronics housing.

FIG. 7 shows an example of the electronics housing 10 in cross sectional view, illustrating locations of power source 24 and internal circuit boards 26 and a transceiver 28 for receiving and transmitting sensor signals. The electronics housing 10 may also include sensors like strain gauges 32 and accelerometers 42 and also gyros. It would be understood by a person of skill in the art that further sensors and elements can be included in the electronics housing 10 without departing from the scope of the present invention. It is also noted that the electronics housing 10 need not be limited to a single housing on the sensored CRT 100, but that more than one electronics housing may be present at different locations of the CRT.

In a first embodiment, sensors are included on the sensored CRT 100 that measure forces and locations of various mechanical elements of the tool. Axial load, rotation speed, rotational position, vibration, CRT alignment with the wellbore, internal pressure of mud conveyed through the sensored CRT 100, X, Y, Z acceleration and location and tool health are acquired via these sensors. In a further preferred embodiment accelerometer 42 style sensors can be used for measuring rotational (RPM) and axial position/height. Strain gages 32 can be used to measure torque, tension, and internal mud pressure. Position sensors 12/22 can also be used to determine rotational and axial position of the mechanical elements 6.

From the sensor measurements, a number of further parameters can be determined, for example mud pressure can be used to calculate information on mud flowrate and volume of mud fill. The present sensors can also provide measurements, that, when processed by the processor, calculates and delivers operational information both during joint makeup as well as in casing while drilling operations.

In this way all of the sensing capabilities of an external torque sub unit are now incorporated directly into the present sensored CRT 100, together with further additional sensors on the various mechanical elements of the CRT.

The sensors within sensored CRT 100 measure the rotation, torque, fluid pressure (of pumped mud), and hook load exerted by the top drive to the drill string or the tubular connection to be made up.

The present sensored CRT 100 has the ability to simultaneously measure pressure, torque, tension, 3-axis acceleration, rpm, rotational turns, and temperature in real-time while also measuring the relative position of the mechanical elements of the CRT. The ability to monitor mechanical elements of the CRT and to convey these measurements and processed CRT information to the operator provides the operator with event more data on the CRT operations and status. Such information and logs of data are useful in predicting proper operation, wear and life of the CRT overall.

The present sensored CRT 100 is connectable to and communicates with a processor to form a system that takes the data from the sensors of the sensored CRT 100, processes the data and presents information to the operator to allow the operator to precisely control the activation of the CRT 100 during makeup, eliminating the need to depend on visual line of sight to the conventional stripe indicators on CRTs. As the sensors are located directly on and in the sensored CRT 100, they present more accurate data than an external torque sub could and precision control is now possible.

The present sensored CRT 100 transmits sensor data to a local or remote processor that perform operations to determine combined loads and limits for the sensored CRT 100. The operator can thus be made aware of operating within combined load limits, eliminating the need for reading and interpreting load charts during operation.

In a further embodiment, the sensored CRT 100 may also receive directions from the processor to control and limit operation of the CRT 100 directly and automatically, to stay within combined load limits and maintain tool integrity. In this way, the sensored CRT 100 together with processor forms a system that can optionally provide either only sensing and display of operational data or both sensing/display and also operational control of the CRT 100, in a form of automation.

With this information, it is also possible to set limiting controls can be applied to a control system of the top drive that will not allow the driller to exceed combined loading limits.

Since the present sensored CRT 100 together with the processor provides information on both tool state (set or unset) along with data related to movement in the z axis, it is now possible to present an accurate total length of tubular inserted into the wellbore and eliminate the need for conventional tally recording. In any casing make up operation, the top drive makes many up and down movements along the z-axis. But only axial movement to feed the tubular into the ground, when the CRT is engaged with the casing string so that top drive movement is conveyed to the string should be counted to tally tubular length. Since the present sensored CRT 100 senses and monitors the position of all mechanical elements of the CRT 100, it is able to sum up z-axis distance at these particular settings, and in turn determine the total length of tubular inserted into the hole.

With two-way communication between the sensored CRT 100 and the processor, automation of makeup and casing while drilling operations is possible due to the ability to control the setting, unsetting of the elevator and CRT 100 and of the spider; and the handoff between these two pieces of equipment.

In the case of rigs that are not equipped to integrate smart CRT sensor data into a control or automation system, audio warnings or visual displays can be presented on the smart CRT itself that warn and instruct the operator on individual or combined loads becoming near limits.

Communication between the present sensored CRT 100 and a spider via the processor can synchronize and control the open and close sequence of the two tools and maintain a positive hold on the tubular string. This will eliminate the possibility of a dropped string from opening both spider and CRT simultaneously.

Figure 8:
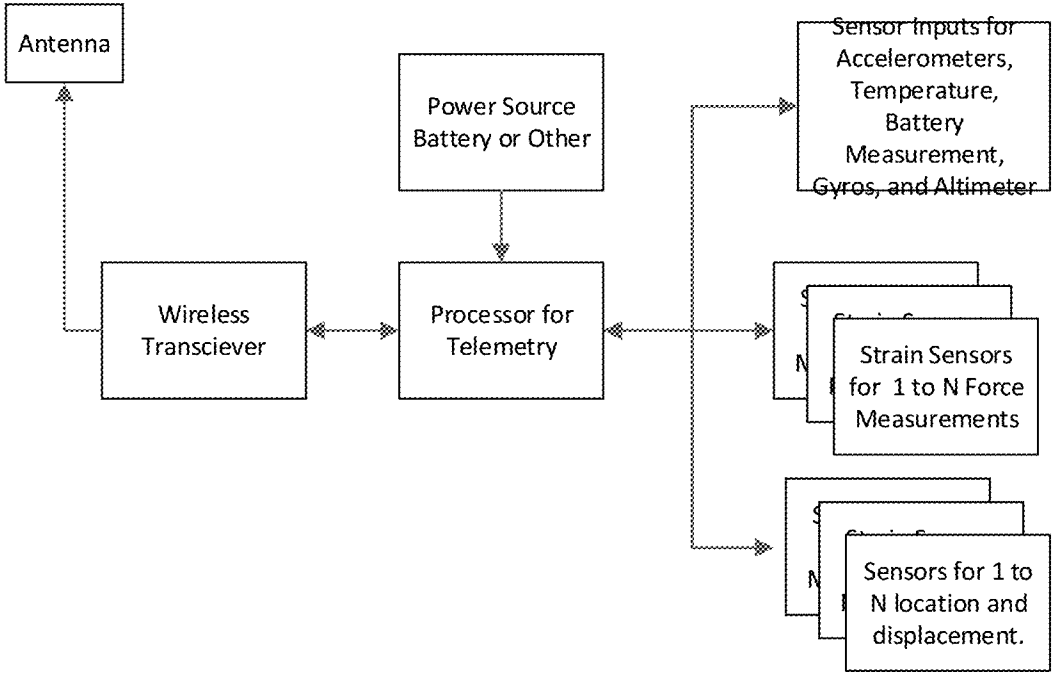
FIG. 8 is a schematic diagram of communications between parts of the present CRT and a transceiver for receiving and transmitting sensor data.
Figure 9:
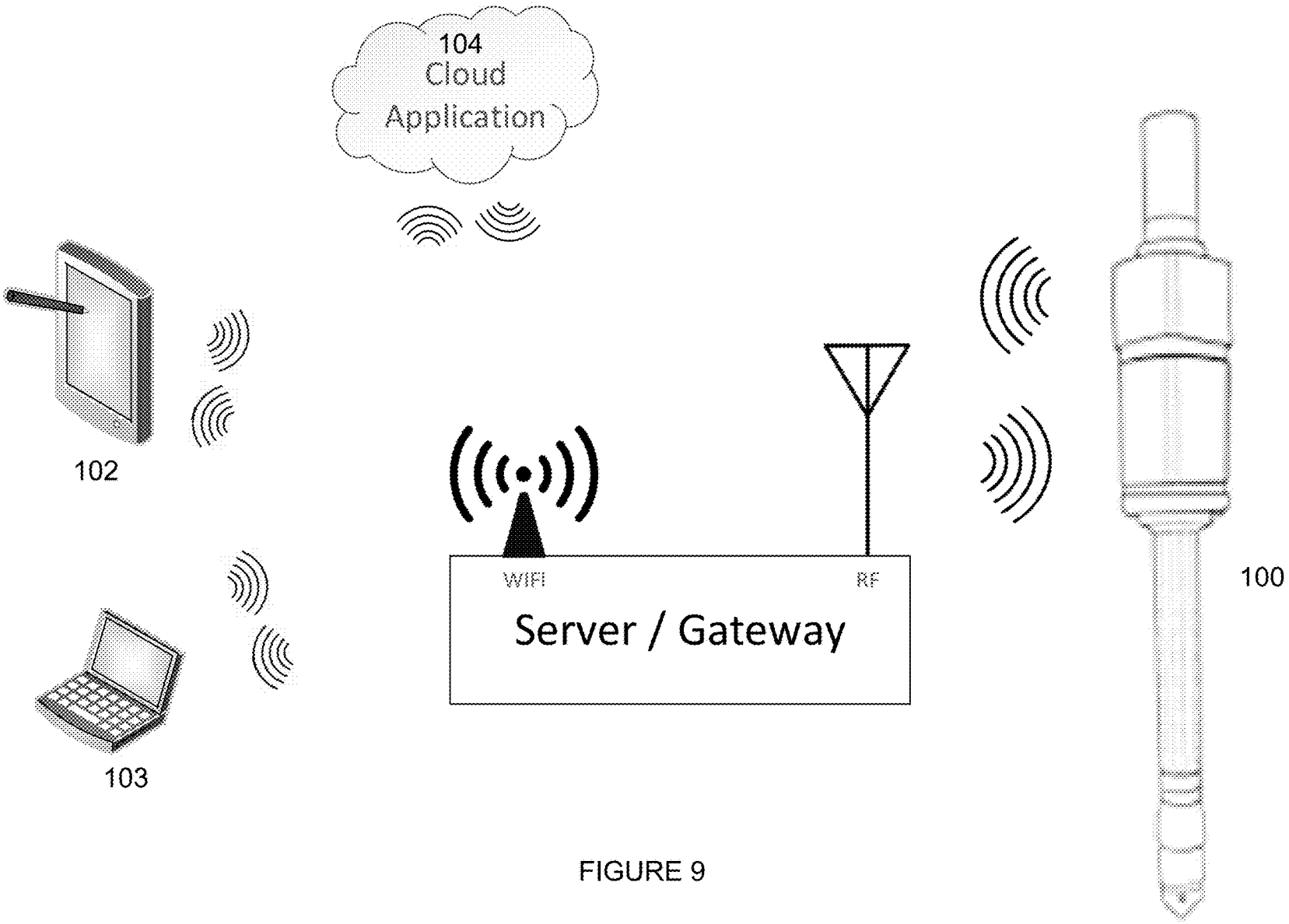
FIG. 9 is a schematic diagram of communications between the present CRT and various external systems.

As illustrated in FIGS. 8 and 9, the present sensored CRT 100 can transmit sensor data to the processor to process said data, said processing involving performing conversions and calculations with the sensor data to determine various status and operation parameters about the sensored CRT 100, related equipment and the installation operation. The resulting processed data is conveyed for viewing in real-time by any one or more of on-site operators 102, remote operators or experts 103, or the processed data can be transmitted to a cloud application 104 for further processing, viewing or storing.

In the present disclosure, the processor can be in the form of a computer such as a laptop, desktop, smartphone or handheld device, receiving sensor data wirelessly, or in the form of a remote receiver at a receiver hub which can process data received by the sensors. In this way sensors of the sensored CRT 100 need only digitize the analog signals from the raw data values collected, with some conditioning as may be required, and transmit those digitized signals. However, no further data processing such as calculations or determining of further parameters is done at the sensored CRT 100. In the case of using the receiver hub, data is most preferably transmitted to the receiver using a radio frequency transmitter, although any other means of transmission including near-field communication, Bluetooth, wireless internet, could be used. Preferably, more than one transmitter is used and can be auto-switched to enhance connectivity to the remote receiver hub.

The processor in the receiver hub is used to digitally process all raw data measurements obtained from the sensors of the sensored CRT 100 to provide values in useful engineering units to external systems.

One benefit of the remote processing of raw data from the sensors of the present sensored CRT 100 is that allows the use of a smaller, and often lower cost, battery to power the sensors of the sensored CRT 100. The present sensors hence do not require a complicated and custom battery pack. Instead, the present sensored CRT 100 can use a commercially available primary battery that can be locally sourced. This in turn alleviates issues associated with producing and shipping custom lithium battery packs. Lithium battery packs are heavily regulated by local and international agencies for transport and shipping, especially by air, due to the volatile nature of lithium.

The electronic circuit design within the electronics housing 10 of the sensored CRT 100 allows the sensors of the present sensored CRT 100 to operate on a single commercially available battery. Optionally the present sensors can be powered for longer periods of time by inclusion of more than one battery in the electronics housing 10.

By providing a system of the present sensored CRT 100 in communication with the processor, the present system can provide in real time the torque and turns data needed to monitor the connection integrity without the need for conventional systems such as torque-sub or turns encoders, proximity sensors or load cells. This reduces the number of subs and equipment needed to be supported on the top drive. As well, since the sensors in the present sensored CRT 100 are dedicated to and located directly on a particular CRT, the data sensed is more accurate and is customized with the CRT's parameters taken into consideration, one example being combined load limits. Removing the sub also reduces the length to the stack-up of the top drive and reduces strain on space limits.

In the present system, the sensored CRT 100 can also communicate back to the processor an accurate tally length to be applied to the torque turn reports. This will enable on site precise length in hole in real time on the rig floor.

The previous description of the disclosed embodiments is provided to enable any person skilled in the art to make or use the present disclosure. Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A casing running tool comprising:

a) a gripping section comprising a gripping mechanism, said gripping mechanism being moveable from a set state in which the gripping mechanism grips a joint of tubular or casing, to an unset state in which the gripping mechanism releases a joint of tubular or casing; and a gearbox comprising mechanical elements used to set and unset the gripping mechanism;

b) one or more sensors built into the mechanical elements of the gearbox of the casing running tool for detecting axial movement, axial position, rotational movement or rotational position of the mechanical elements; and c) an electronics housing built into the casing running tool, said electronics housing comprising:

i. one or more power sources for powering said one or more sensors;

ii. one or more circuit boards for converting sensor data for transmission;

iii. transmission means for transmitting sensor data; and iv. one or more sensors selected from the group consisting of strain gauges, accelerometers, gyros and combinations thereof, wherein said one or more sensors are for sensing if the gripping section is in a set state or unset state, and for sensing operational parameters of the casing running tool comprising axial load, axial position, torque, turns, internal mud pressure, hook load, tension, rotation speed, rotational position, vibration, alignment, X, Y, Z acceleration and temperature.

2. The casing running tool of claim 1, wherein the one or more sensors comprise one or more sensors built into mechanical elements of the casing running tool.

3. The casing running tool of claim 2, wherein the one or more sensors comprise position sensors located in the mechanical elements for sensing set or unset state of the gripping section, and rotational and axial position of the casing running tool.

4. The casing running tool of claim 1, wherein the one or more circuit boards serve to convert sensor signals from analog to digital.

5. The casing running tool of claim 4, wherein the transmission means comprises a transceiver for receiving digitized sensor signals and transmitting the digitized signals.

6. The casing running tool of claim 5, wherein the transceiver transmits digitized sensor signals to a processor for processing said sensor signals and transmitting processed data in real-time for viewing by an operator.

7. The casing running tool of claim 6, wherein the one or more power sources comprises a battery located in the electronics housing.

8. A system for detection, processing and transmission of one or more parameters of set or unset state of gripping section of a casing running tool and operational status of a casing running tool or associated tools in a casing installation or casing while drilling operation, said system comprising:

a. the casing running tool of claim 1; and b. a processor for receiving sensor data for processing and transmitting processed data in real-time for viewing by an operator.

9. The system of claim 8, wherein the processor is selected from the group consisting of a computer, a remote receiver and a combination thereof.

10. The system of claim 9, wherein the computer receives sensor data wirelessly and wherein the remote receiver is located at a receiver hub and receives sensor data from a means selected from the group consisting of radio frequency, near-field communication and wireless.

11. The system of claim 8, wherein the transmission means further receives directions from the processor to control operation of any one of the casing running tool, the associated tools or both, directly and automatically, based on processed sensor data.

12. The system of claim 8, wherein the processor receives sensor data on internal mud pressure and processes the data to determine mud flowrate and volume of mud fill.

13. The system of claim 8, wherein sensor data from the casing running tool is processed by the processor to determine combined loads and combined load limits on the casing running tool and transmit combined loads and combined load limits to the operator.

14. The system of claim 13, wherein combined load limits information is used to set limiting controls to a control system of a top drive in use with casing running tool.

15. The system of claim 8, wherein the processor receives sensor data from casing running tool on tension and movement in the z axis and processes sensor data to determine total length of a casing string being installed.

16. A method of performing a casing installation or casing while drilling operation, said method comprising the steps of:

a. providing the casing running tool of claim 1;

b. transmitting sensor data on set or unset state of a gripping section of a casing running tool and operational parameters during the operation to a processor;

c. processing sensor data by the processor to determine information on set or unset state of gripping section and operational status;

d. transmitting information on set or unset state of gripping section and operational status to an operator from the processor; and e. controlling and adjusting the setting or unsetting of gripping section and operational parameters of the casing running tool or associated tools.

17. The method of claim 16, wherein controlling and adjusting the setting or unsetting of gripping section and operational parameters of the casing running tool is performed by the operator.

18. The method of claim 16, wherein controlling and adjusting the setting or unsetting of gripping section and operational parameters of the casing running tool is performed automatically on directions from the processor.

19. The method of claim 16, wherein sensor data on internal mud pressure is transmitted to the processor and wherein the processor processes the data to determine mud flowrate and volume of mud fill.

20. The method of claim 16, wherein sensor data from the casing running tool is processed by the processor to determine information combined loads and combined load limits and to transmit combined loads and combined load limits information to the operator.

21. The method of claim 20, further comprising the step of setting limiting controls on a top drive in use with casing running tool, based on combined load limits information.

22. The method of claim 16, wherein sensor data on tension and movement in the z axis is transmitted to the processor and wherein the processor processes the data to determine total length of a casing string being installed.

* * * * *